US007680426B2

(12) United States Patent
Fujimori

(10) Patent No.: US 7,680,426 B2
(45) Date of Patent: Mar. 16, 2010

(54) IMAGE FORMING APPARATUS WITH AIR FLOW BLOCKING MECHANISM

(75) Inventor: Shinichiro Fujimori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 157 days.

(21) Appl. No.: 11/955,964

(22) Filed: Dec. 13, 2007

(65) Prior Publication Data

US 2009/0028612 A1 Jan. 29, 2009

(30) Foreign Application Priority Data

Jun. 26, 2007 (JP) ..... 2007-167850

(51) Int. Cl.
*G03G 15/08* (2006.01)
*G03G 15/09* (2006.01)

(52) U.S. Cl. ..... 399/53; 399/92; 399/228; 399/267

(58) Field of Classification Search ..... 399/267, 399/91, 92, 53, 228
See application file for complete search history.

(56) References Cited

U.S. PATENT DOCUMENTS 4,860,053 A * 8/1989 Yamamoto et al. ..... 399/228
2004/0223779 A1* 11/2004 Satoh ..... 399/267 X
2006/0104657 A1* 5/2006 Mori ..... 399/92

FOREIGN PATENT DOCUMENTS

JP 2003-015420 1/2003

* cited by examiner

*Primary Examiner*—Sophia S Chen
(74) *Attorney, Agent, or Firm*—Morgan, Lewis & Bockius LLP

(57) ABSTRACT

In a configuration with a plurality of developing units, an influx of air into one developing unit from another developing unit can be blocked with a simple configuration. An operation section for a developing unit that is not in operation rotates a developer roll in the reverse direction to move developer accumulated on a pickoff pole, and fills a clearance formed between a housing and the developer roll with the developer so that the air flow of the developing unit that is not in operation is blocked. Accordingly, even if a difference in pressure between a developing unit that is in operation and a developing unit that is not in operation occurs, an air flow from the developing unit in operation to the developing unit not in operation is not apt to be formed, and an influx of air into the developing unit that is not in operation is blocked.

14 Claims, 6 Drawing Sheets

IMAGE FORMING APPARATUS WITH AIR FLOW BLOCKING MECHANISM

CROSS-REFERENCE TO RELATED APPLICATION

This application is based on and claims priority under 35 USC 119 from Japanese Patent Application No. 2007-167850 filed on Jun. 26, 2007.

BACKGROUND

1. Technical Field

The present invention relates to an image forming apparatus.

2. Related Art

As an image forming apparatus for forming an image, an image forming apparatus has been known. The image forming apparatus includes a two component developer replacing means for automatically replacing a two component developer in a developing apparatus, an opening for releasing the inner pressure of the developing apparatus and a vent duct for discharging air to the outside from the apparatus.

The vent duct passes through a waste developer container for discarding a used developer in the two component developer replacing means, and a toner filter is provided in the waste developer container.

According to this configuration, air discharged from the opening of the developing apparatus is filtered through the filter provided in the waste developer container, and is discharged through the vent duct to the outside from the apparatus.

However, in such an image forming apparatus, plural developing units are connected with each other via a vent duct or a waste developer container. When the developing units are operated, the pressure within the developing units increases due to the heat generated by the operation of the developing units, the rotation of developer rolls or the like, so that toner-containing air in the developing units tends to flow to lower-pressured sections in the image forming apparatus. Accordingly, when both a developing unit that is in operation and a developing unit that is not in operation are present in the same time, air flows from the developing unit that is in operation to the developing unit that is not in operation through the waste developer container or the vent duct due to the difference in pressures therebetween. Therefore, the toner-containing air to be discharged through the toner filter flows into the developing unit that is not in operation, resulting in occurrence of problems such as color mixing.

SUMMARY

In view of the above facts, an object of the present invention is to provide an image forming apparatus having plural developing units capable of blocking an air flow from one developing unit to another developing unit with a simple configuration.

An image forming apparatus according to the present invention comprises plural developing units for developing a latent image with developer, a connection path for connecting with the interiors of the plural developing units, a control unit for controlling the operation of the plural developing units, and an air flow blocking mechanism for blocking the air flow of a developing unit that is not in operation by filling a clearance formed in the developing unit that is not in operation with the developer when both a developing unit that is in operation and a developing unit that is not in operation are present among the plural developing units.

BRIEF DESCRIPTION OF THE DRAWINGS

Exemplary embodiments of the present invention will be described in detail based on the following figures, wherein.

DETAILED DESCRIPTION

Hereinafter, an exemplary embodiment according to the present invention will be explained with reference to the drawings.

(Overall Configuration of Image Forming Apparatus According to the Present Embodiment)

Figure 1:
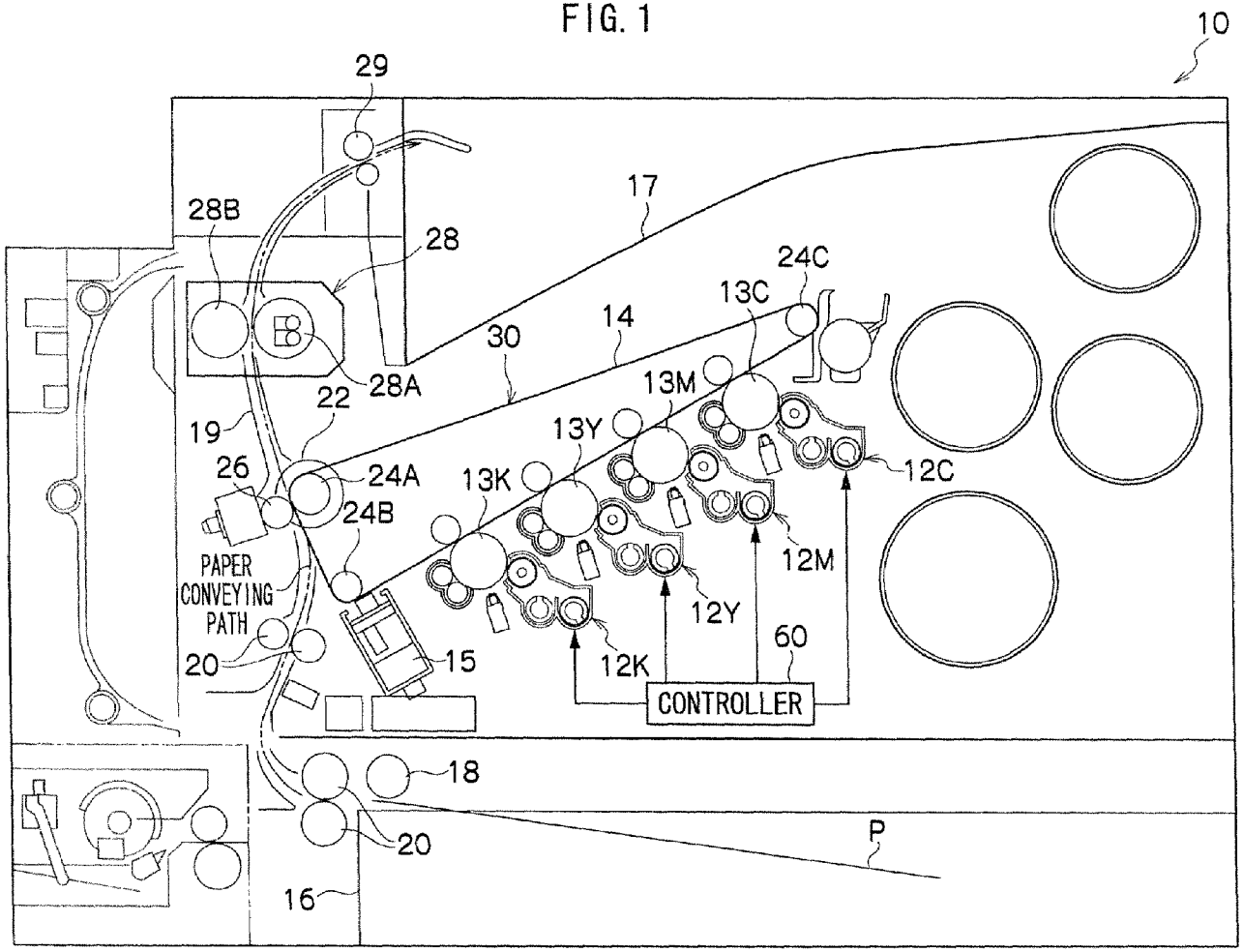
FIG. 1 is a schematic view showing an overall configuration of the image forming apparatus according to the present embodiment.
Figure 2:
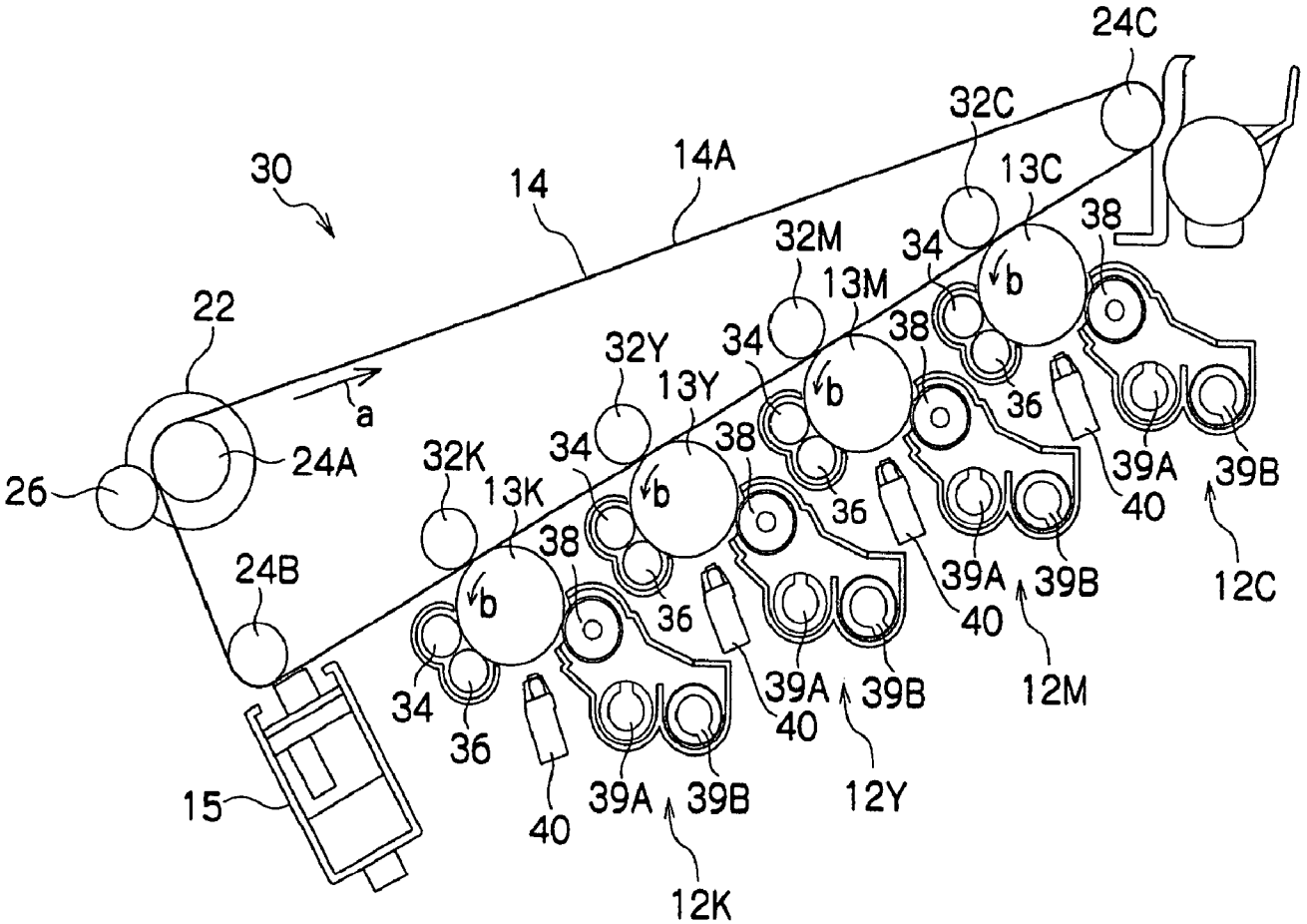
FIG. 2 is a schematic view showing an image forming section provided in the image forming apparatus according to the present embodiment.
Figure 3:
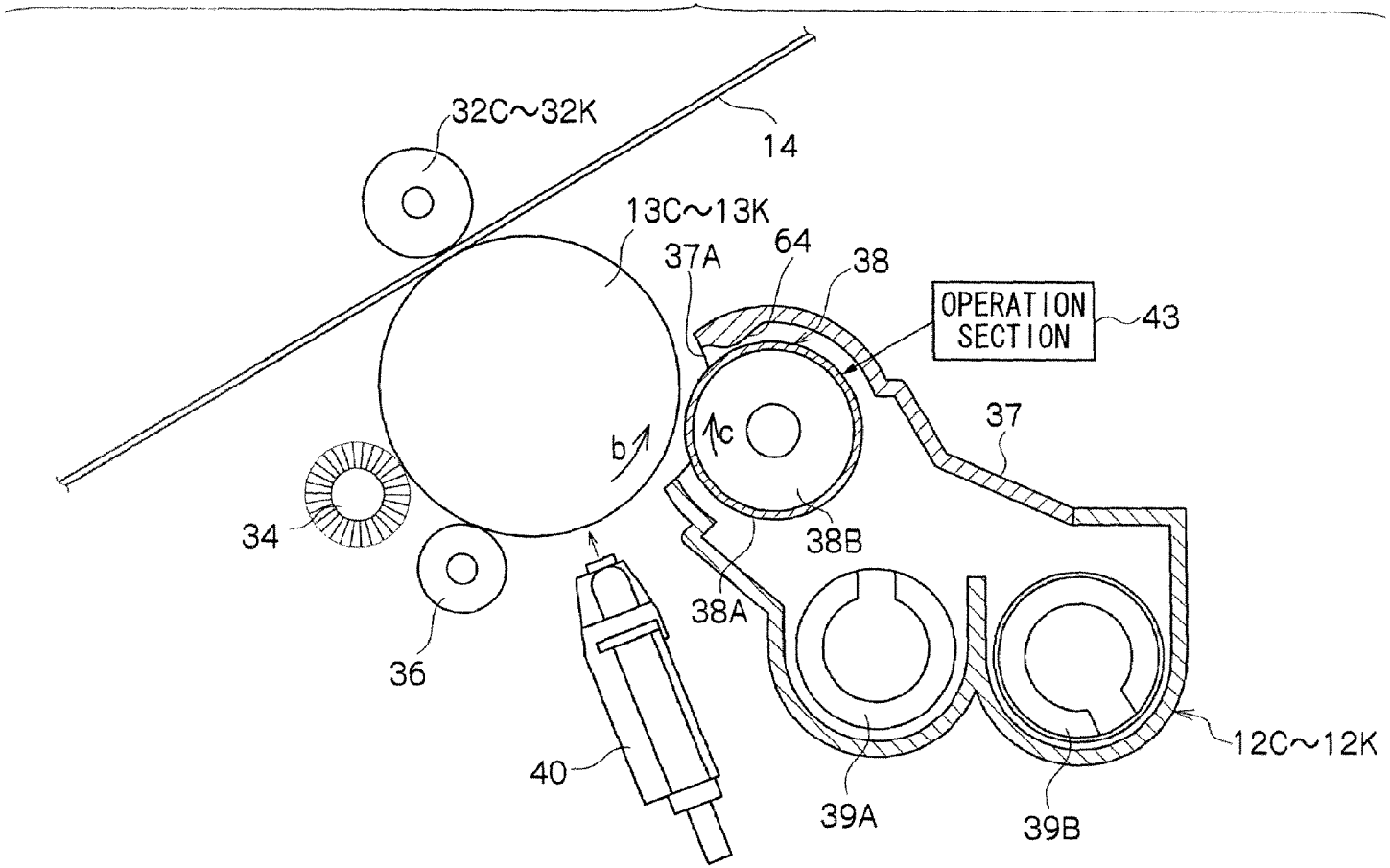
FIG. 3 is a schematic view showing a photoreceptor provided in the image forming apparatus and the configuration in the vicinity thereof according to the present embodiment.

First, an overall configuration of an image forming apparatus according to the present embodiment is explained. FIG. 1 is a schematic view showing the overall configuration of the image forming apparatus according to the present embodiment. FIG. 2 is a schematic view showing an image forming section provided in the image forming apparatus according to the embodiment. FIG. 3 is a schematic view showing a photoreceptor provided in the image forming apparatus and the configuration in the vicinity thereof according to the embodiment.

The image forming apparatus 10 according to the embodiment is an apparatus for forming an image, and as shown in FIG. 1, comprises an image forming section 30 for forming an image with developers of four color inks of cyan, magenta, yellow and black, and a paper feed section 16 provided under the image forming section 30, and a paper discharge section 17 provided above the image forming section 30.

In the image forming section 30, as shown in FIGS. 1 and 2, photoreceptors 13C, 13M, 13Y and 13K (hereinafter referred to as "13C-13K") as latent image carriers for holding latent images are provided corresponding to colors of cyan, magenta, yellow and black, respectively. The photoreceptors 13C-13K, each rotate in a prescribed direction (in the direction of an arrow b in FIG. 2).

As shown in FIGS. 2 and 3, on the periphery of each of the photoreceptors 13C-13K, an intermediate transfer belt 14, a brush roll 34, a charge roll 36 and an LED array head 40 as an exposure device along the rotation direction b of each of the photoreceptors 13C-13K in this order.

The intermediate transfer belt 14, the brush roll 34 and the charge roll 36 are in contact with the surface of each of the photoreceptors 13C-13K, respectively. Further, developing units 12C, 12M, 12Y and 12K (hereinafter referred to as "12C-12K) for developing latent images with developers are provided at the downstream side of the LED array heads 40 and the upstream side of the intermediate transfer belt 14 in the rotation direction of the photoreceptors 13C-13K, respectively.

The surface of each of the photoreceptors 13C-13K is uniformly charged with the charge roll 36, and the surface of each of the charged photoreceptors 13C-13K is exposed with the beam of the LED array head 40 to form an electrostatic latent image corresponding to image data on the surface of each of the charged photoreceptors 13C-13K. The electrostatic latent images formed on the photoreceptors 13C-13K are developed by the developing units 12C-12K to form toner images on the photoreceptors 13C-13K.

The intermediate transfer belt 14 is formed in an endless shape, and as shown in FIG. 2, is wound around and supported by a belt transfer roll 24A, a belt transfer roll 24B disposed below the belt transfer roll 24A, and the belt transfer roll 24C disposed obliquely above the transfer roll 24A at the opposite side of the belt transfer roll 24A from a paper conveying path 19.

The outer peripheral surface of the intermediate transfer belt 14 is a transfer surface 14A onto which toner images are transferred, and the developing units 12C-12K and the photoreceptors 13C-13K are juxtaposed, respectively, and the photoreceptors 13C -13K are in contact with the transfer surface 14A, respectively.

On the other hand, transfer rolls 32C, 32M, 32Y and 32K (hereinafter referred to as "32C-32K") are disposed at the opposite side of the intermediate transfer belt 14 from the photoreceptors 13C-13K, and the intermediate transfer belt 14 is pressed onto the photoreceptors 13C-13K by the transfer rolls 32C-32K, respectively.

The image forming apparatus 10 is a so-called tandem type full color printer, and four color toner images formed by being developed by the developing units 12C-12K are superposed on one another on the intermediate transfer belt 14 while the intermediate transfer belt 14 makes one round.

A toner density detection sensor 15 is disposed so as to face the transfer surface 14A at the downstream side of the photoreceptor 13K and adjacent thereto with respect to the rotation direction of the intermediate transfer belt 14, as shown by an arrow a in FIG. 2. The toner density detection sensor 15 has a function to detect the density of toner that has been transferred onto the transfer surface 14A.

As shown in FIG. 1, above the paper feed section 16, a paper feed roll 18 is arranged so as to be in contact with the leading end of the paper P loaded on the paper feed section 16 in the conveying direction. Further, the conveying path 19 for conveying the paper P extends upward in an S shape from the side where the paper feed roll 18 is provided in the paper feed section 16 toward the paper discharge section 17 via a transfer section 22 and a fix section 28. Two pair of convey rolls 20 are disposed on the conveying path 19. The paper P is conveyed upward by the convey roll 20 along the conveying path 19 as shown by an arrow illustrated with a dashed-two dotted line in FIG. 1, one by one from the paper feed section 16 by the paper feed roll 18, and conveyed to the discharge section 17 through the transfer section 22 and the fix section 28.

In the transfer section 22, the belt transfer roll 24A around which the intermediate transfer belt 14 is entrained, and a transfer roll 26 pressed to the belt transfer roll 24A are disposed. The intermediate transfer belt 14 is nipped between the belt transfer roll 24A and the transfer roll 26, and a toner image is transferred onto the paper P from the intermediate transfer belt 14 when the paper P passes through the nip portion.

The fix section 28 is disposed above the transfer section 22. The fix section 28 includes a heat roll 28A and a backup roll 28B contact-pressed to the heat roll 28A. When the paper P passes through the nip portion of the heat roll 28A and the backup roll 28B, toner is fused and coagulated so that the toner image is fixed. The paper P on which the toner image has been fixed at the fix section 28 is discharged to the discharge section 17 by a discharge roll 29 disposed at the downstream side of the fix section 28 in the conveying direction.

(Configurations of Developing Units 12C-12K and in the Vicinity Thereof)

Next, the configurations of developing units 12C-12K and in the vicinity thereof will be described.

As shown in FIG. 3, the developing units 12C-12K, each comprise the housing 37 having an opening 37A at the position facing the photoreceptors 13C-13K, respectively.

A developer roll 38 for supplying a two component developer to a latent image formed on each of the photoreceptors 13C-13K, and screw feeders 39A and 39B as a transport member for transporting the two component developer to the developer roll 38 are housed in the housing 37. The two component developer contains toner and magnetic carrier particles as main component. As the developer, not only is a two component developer used, but also one component developer may be used.

The screw feeders 39A and 39B are disposed below the developer roll 38. With the rotation of the screw feeders 39A and 39B, the two component developer is transported along the direction of the rotation axis of the developer roll 38 while being stirred, so that the two component developer is supplied to the developer roll 38.

As shown in FIG. 3, the developer roll 38 is positioned at the opening 37A of the housing 37 so as to face each of the photoreceptors 13C-13K, so that a clearance (developing gap) is formed between the developer roll 38 and the surface of each of the photoreceptors 13C-13K. Further, the developer roll 38 has a cylindrical inner cylinder 38B and a sleeve 38A for covering the cylinder 38B.

The inner cylinder 38B is secured to the apparatus main body of the image forming apparatus 10 so as not to be rotated. The sleeve 38A, as shown by an arrow c in FIG. 3, is structured so as to rotate around the axis of the inner cylinder 38B in the opposite direction to the rotation direction b of the photoreceptors 13C-13K. That is, the photoreceptors 13C-13K rotate in the counter clockwise direction in FIG. 3, whereas the developer rolls 38 rotate in the clockwise direction.

Figure 4B:
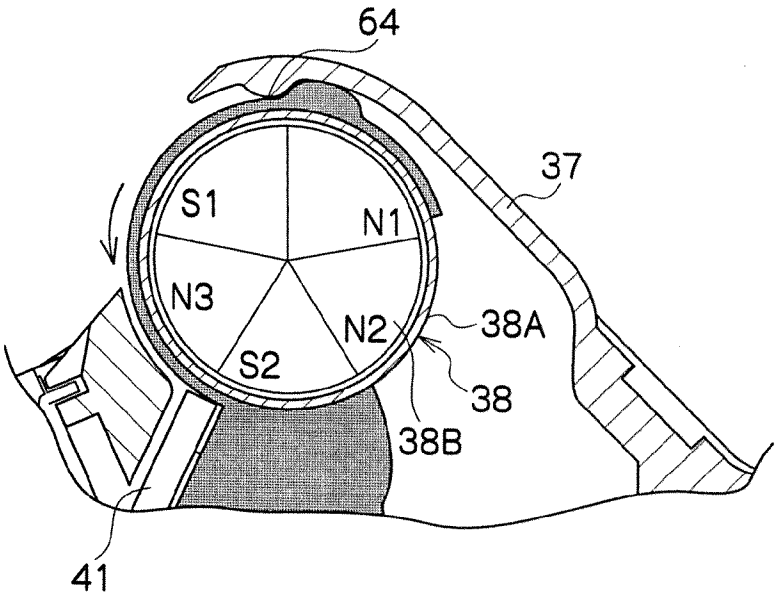
FIG. 4A and FIG. 4B are schematic views illustrating an air flow blocking mechanism which blocks air flow according to the present embodiment.
Figure 4A:
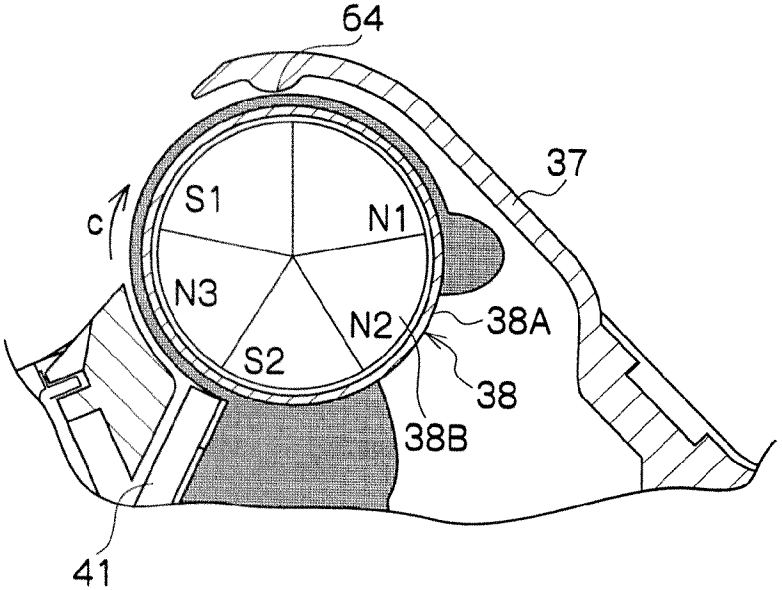

As shown in FIGS. 4A and 4B, five permanent magnets are radially embedded in the inner cylinder 38B such that S poles and N poles are alternately formed on the surface of the inner cylinder 38B along the rotation direction of the sleeve 38A. Here, in FIGS. 4A and 4B, the S1 pole is a developing pole, and the S1 pole are disposed at positions respectively facing the photoreceptors 13C-13K. Along the rotation direction c of the sleeve 38A, a pickoff pole N1 is disposed adjacent to the developing pole S1 and magnetic poles are disposed adjacent thereto in the order of a pickup pole N2, a trimming pole S2, and a transport pole N3.

At the opposing portion facing the trimming pole S2, a trimming blade 41 for aligning the height of the magnet brush layer in cooperation with the trimming pole S2 is extended toward the developer roll 38.

Both the developer pole S1 and the trimming pole S2 are the S pole, and all the pickoff pole N1, the pickup pole N2 and the transport pole N3 are the N pole. A negative bias voltage is applied to the developer roll 38.

In the developing units 12C to 12K, when the sleeve 38A rotates along the rotation direction c, first, the two component developer supplied to the developer roll 38 by means of the screw feeders 39A and 39B is attracted to the surface of the sleeve 38A by the pickup pole N2. Here, on the surface of the sleeve 38A, a magnetic field toward the developer pole S1 from the transport pole N3, a magnetic field toward the developer pole S1 from the pickoff pole N1, a magnetic field toward the trimming pole S2 from the pickup pole N2 and a magnetic field toward the trimming pole S2 from the transport pole N3 are formed. In addition, the two component developer has a structure in which toner is adhered onto the surface of the magnetic carrier particles. Accordingly, in the two component developer attracted to the surface of the sleeve 38A, the magnetic carrier particles are aligned in the direction of the magnetic force lines along the direction of the magnetic fields (the direction of the vector B of the magnetic flux density) on the surface of the sleeve 38A, to form a magnetic brush.

The magnetic brush formed (held) on the surface of the sleeve 38A in the vicinity of the pickup pole N2 is transported (moved) toward the trimming pole S2, the transport pole N3, the developer pole S1, and the pickoff pole N1, in this order, along the surface of the sleeve 38A, accompanying rotation of the sleeve 38A along the rotation direction c. When the magnetic brush passes through the trimming pole S2, while the height of the magnetic brush is aligned, the toner on the magnetic brush is transferred to the photoreceptors 13C-13K in the vicinity of the developer pole S1, and a magnetic brush containing substantially only magnetic carrier particles remains on the surface of the sleeve 38A. The magnetic brush containing substantially only magnetic carrier particles is dropped off from the surface of the sleeve 38A at the pickoff pole N1 accompanying the rotation of the sleeve 38A, and returns into the housing 37.

As described above, with the rotation along the rotation direction c of the sleeve 38A, a fresh two component developer is always replenished at the pickup pole N2 and transported to the developer pole S1. At the developer pole S1, the toner is transferred to the photoreceptors 13C-13K, and the latent image on the surface of each of the photoreceptors 13C-13K is developed.

Figure 5:
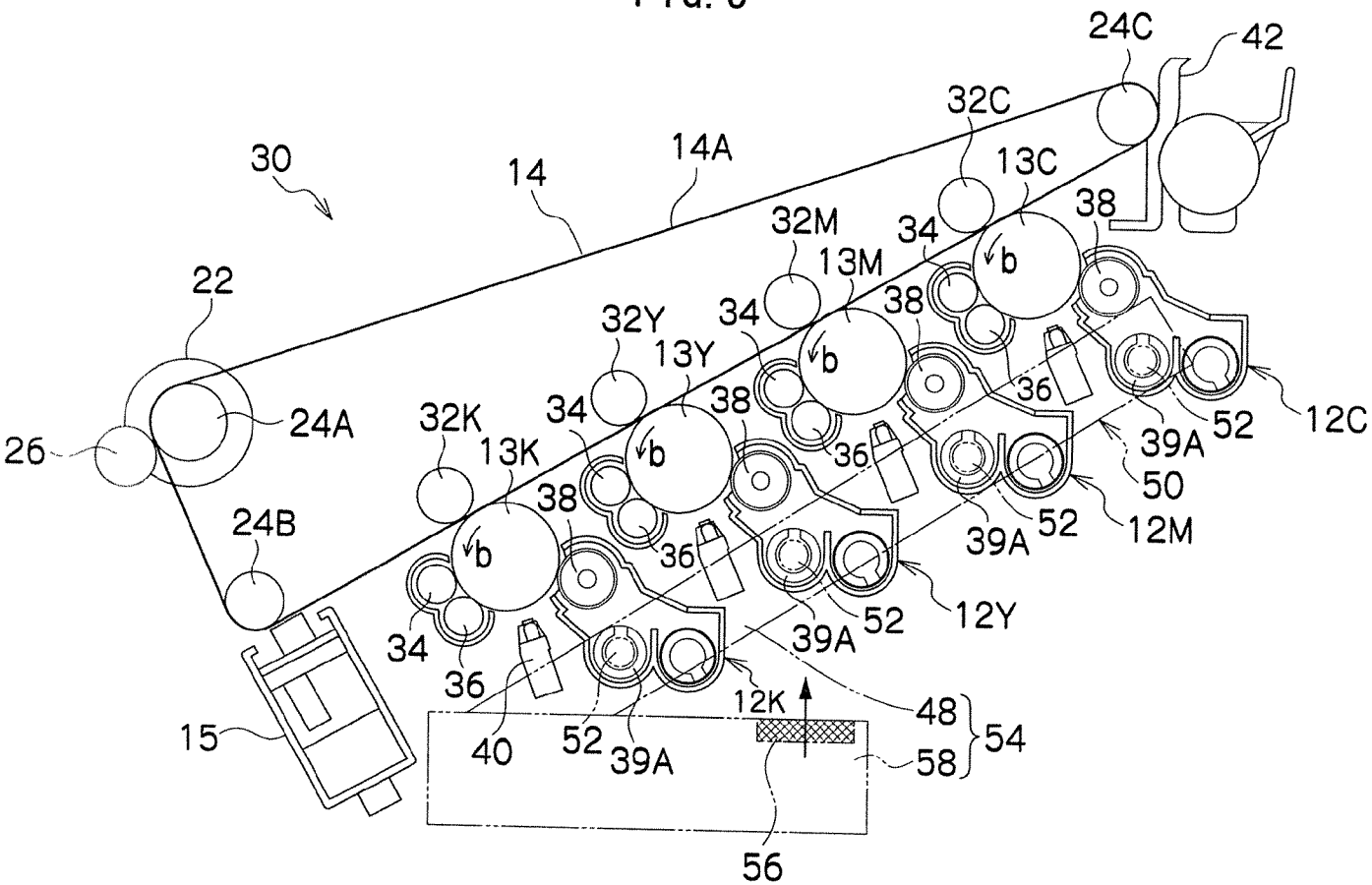
FIG. 5 is a schematic view showing a configuration of a connection path according to the present embodiment.

Further, in the present embodiment, as shown in FIG. 5, a connection path 50 is provided at the side face of the developing units 12C-12K, to connect with the interiors of the plural developing units 12C-12K.

The connection path 50 is composed of an air vent hole 52 provided at each of the developing units 12C-12K for removing air from the interior of each of the developing units 12C-12K, a discharge path 54 that connects with each of the air vent holes 52 for discharging the air removed from the air vent hole 52, and a filter member 56 provided in the discharge path 54 for eliminating the developer in the air discharged from the air vent hole 52.

The air vent hole 52 is formed on the one side face of each of the developing units 12C-12K at one end side in the direction of the rotation axis of the screw feeder 39A. The air vent hole 52 is formed such that the air and waste developer are discharged through the air vent holes 52 from the developing units 12C-12K.

The discharge path 54 is composed of a waste developer container 58 for accommodating developer to be discarded and a vent duct 48. One end of the vent duct 48 connects with each of the vent holes 52 and the other end thereof connects with the waste developer container 58.

The developer discharged from the developing units 12C-12K through the air vent holes 52 descends downward at a slant through the vent duct 48 formed with a falling gradient, and is housed in the waste developer container 58.

The filter member 56 is disposed at the upper portion of the waste developer container 58, and the portion where the filter member 56 is disposed connects with the outside of the waste developer container 58.

In the present embodiment, the air removed from the developing units 12C-12K through the vent holes 52 passes through the vent duct 48 and the waste developer container 58, and further passes through the filter member 56 to eliminate the developer. The air from which the developer has been eliminated by the filter member 56 is discharged to the outside of the image forming apparatus 10. The developer eliminated with the filter member 56 drops into the waste developer container 58 under its own weight.

Further, the vent duct 48 connects with the vent hole 52 of each of the developing units 12C-12K, so that the developing units 12C-12K connect with each other and an air can be flowed among the developing units 12C-12K.

As shown in FIG. 1, a controller 60 as a control unit is connected to the developing units 12C to 12K to control the operation of the developing units 12C to 12K.

When the controller 60 transmits drive signals to the developing units 12C to 12K for operating the developing units 12C to 12K, the developing units 12C to 12K come to be operated.

When the developing units 12C-12K that have been operated are stopped due to the controller 60 transmitting stop signals to the developing units 12C-12K, the developing units 12C-12K become non-operated developing units which are put into a non-operated state in which they do not operate.

The image forming apparatus 10 can switch between a multicolor image forming mode for forming a multicolor image (for example, full color image) with plural colors and a monochromatic image forming mode for forming a monochromatic image (for example, black and white monochromatic image). That is, the controller 60 selects at least one of the developing units among the developing units 12C to 12K to be operated in accordance with the image forming mode.

For example, in the full color image forming mode for forming a full color image as a multicolor image, the controller 60 actuates all the developing units 12C to 12K. In the monochromatic image forming mode for forming a black and white monochromatic image as a monochromatic image, the controller 60 actuates the developing unit 12K, however it does not actuate the developing units 12C to 12Y.

Accordingly, in a monochromatic image forming mode such as the black and white monochromatic image, a developing unit that is in operation and developing units that are not in operation among the developing units 12C-12K are present.

The image forming apparatus 10 according to the present exemplary embodiment, is provided with an air flow blocking mechanism that enhances the air flow of a developing unit that is not in operation by filling a clearance formed in the developing unit that is not in operation with the developer when both an operated developing unit that has been put in an operated state and a non-operated developing unit that has been put in a non-operated state are present among the developing units 12C-12K.

The air flow blocking mechanism is constituted by an operation section 43 as a developer moving unit that moves developer to the clearance formed between the housing 37 and the developer roll 38 to fill the clearance.

The operation section 43 is constituted so as to fill the clearance formed between the housing 37 and the developer roll 38 with the developer by moving the developer adhered to the developer roll 38 by rotating the developer roll 38 by a predetermined angle in the reverse direction.

The operation section 43 moves the developer accumulated on the repulsion pole, i.e. the pickoff pole N1, of the developer roll 38.

In the present embodiment, a protrusion portion 64 protruding toward the developer roll 38 on the inner surface of the housing 37 is formed at the clearance at the downstream side in the rotation direction of the developer roll 38 with reference to the opening portion 37A of the housing 37.

When the developer roll 38 is rotated in the reverse direction and the developer is moved to the clearance at the downstream side in the rotation direction of the developer roll 38, the developer is compressed by the protrusion portion 64 and becomes in a highly dense state. Further, the developer fills the clearance formed between the housing 37 and the developer roll 38 over the longitudinal direction, and the air flow of the developing unit that is not in operations can be blocked. That is, the protrusion portion 64 which moves the developer to the clearance functions as a compressing member.

This configuration, in which a clearance formed in a developing unit that is not in operation is filled with developer, includes the case where the clearance which has not been packed with anything is packed with developer, and the case where the clearance which has already been packed with the developer or the like is additionally packed with developer to increase the density at which the clearance is packed. That is, it is sufficient that the clearance (density of clearance) is reduced after the clearance has been filled with the developer, in comparison to before the clearance is filled with the developer, and that the air flow of the developing unit that is not in operation is thereby increased.

Further, taking the opening portion 37A of the housing 37 as a reference, at the upstream side in the rotation direction of the developer roll 38, the clearance between the developer roll 38 and the housing 37 is filled with the developer attracted to the developer roll 38 and with a trimming blade 41, and air flow is maintained.

The operation section 43 is connected to the controller 60 that controls the timing for the rotation of the developer roll 38 in the reverse direction.

For example, when the operation section 43 receives a command for executing a monochromatic image mode, the rotation of the developer rolls 38 is reversed in the developing units that are not in operation to fill the clearances with the developers.

Further, in preparation for arising the situation that a developing unit that is in operation, and a developing unit that is not in operation are present, the developer roll may be rotated in the reverse direction and may be stopped each time when the developer roll is stopped from being in operation, so that the clearance can be filled with the developer at the time when the operation state is changed from being in operation to not being in operation.

ACTION OF THE PRESENT EMBODIMENT

Next, the action of the embodiment is described.

In the embodiment, the operation section 43 for the developing unit that is not in operations rotates the developer roll 38 by a predetermined angle in the reverse direction to move an accumulated developer on the pickoff pole N1. Then, the moved developer can fill the clearance formed between the housing 37 and the developer roll 38, therefore the air flow of the developing unit that is not in operation is blocked.

In this way, even if difference in pressures between a developing unit that is in operation and a developing unit that is not in operation occurs, an air flow from the developing unit that is in operation to the developing unit that is not in operation is not apt to take place, and an influx of air into the developing unit that is not in operation is blocked.

Figure 6B:
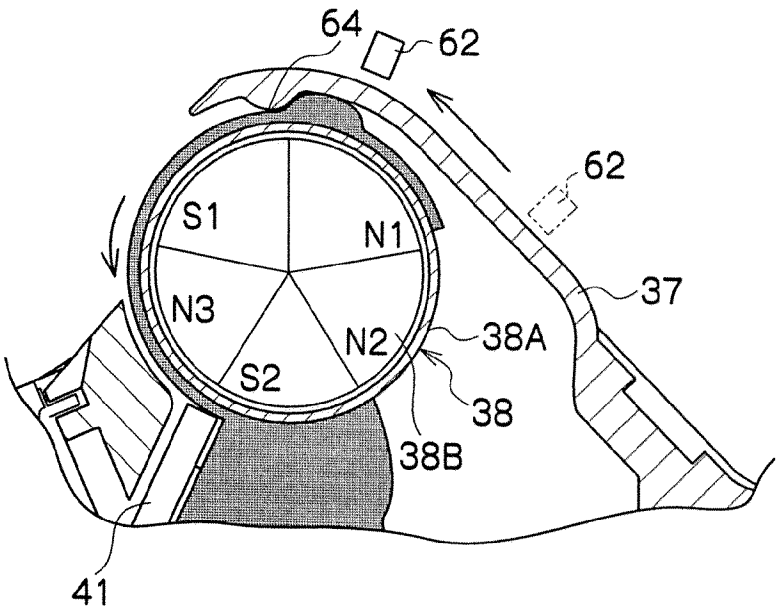
FIG. 6A and FIG. 6B are schematic views showing a modified embodiment in which a developer moving unit is replaced with a magnetic member.
Figure 6A:
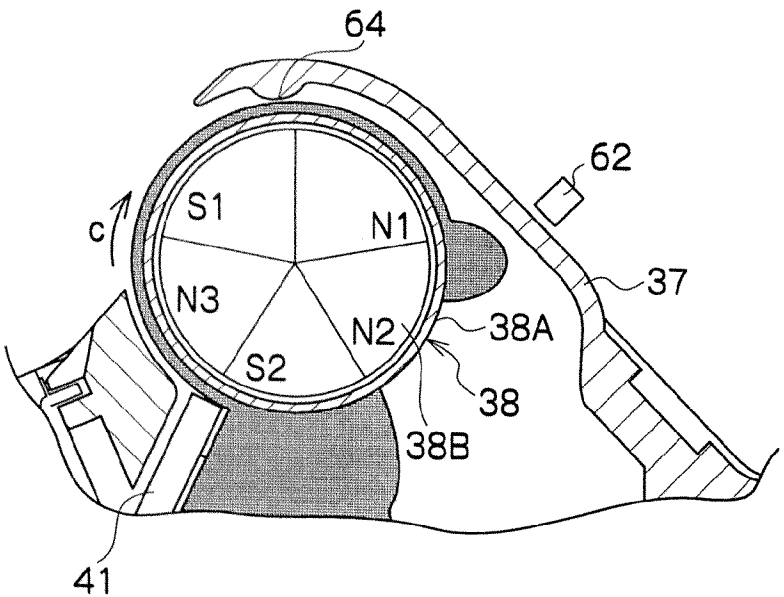

As shown in FIGS. 6A and 6B, the developer moving unit may be a magnetic member 62 that is provided at the outside of the developing unit and moves the developer by a magnetic force.

According to this configuration, the magnetic member 62 is moveably provided along the outer peripheral surface of the housing 37, and the developer accumulated on the repulsion pole of the developer roll 38 is moved to the clearance formed between housing 37 and developer roll 38.

Accordingly, since the developer is moved by the magnetic force of the magnetic member 62, the developer can be raised in the form of toner bristles, and the air flow of the developing unit that is not in operation can be made to stand up in the form of bristles.

The present invention is not limited to the above embodiments, but various modifications, alterations and improvements thereof can be made.

What is claimed is:

1. An image forming apparatus comprising:

a plurality of developing units for developing a latent image with developer;

a connection path for connecting with the interiors of the plurality of developing units;

a control unit for controlling the operation of the plurality of developing units; and, an air flow blocking mechanism for blocking an air flow of a developing unit that is not in operation by filling a clearance formed in the developing unit that is not in operation with the developer when both a developing unit that is in operation and a developing unit that is not in operation are present among the plurality of developing units.

2. The image forming apparatus according to claim 1, wherein the developing unit comprises:

a housing having an opening; and a developer roll disposed at the opening of the housing for supplying the developer to the latent image, wherein the air flow blocking mechanism includes a developer moving unit for moving the developer to the clearance formed between the housing and the developer roll to fill the clearance.

3. The image forming apparatus according to claim 2, wherein the developer moving unit moves developer accumulated on a repulsion pole of the developer roll.

4. The image forming apparatus according to claim 3, wherein:

the developer roll comprises five permanent magnets, which are composed of a developing pole, a pickoff pole adjacent to the developing pole, a pickup pole adjacent to the pickoff pole, a trimming pole, and a transport pole, and which are disposed in this order along a rotation direction of the developer roll; and the repulsion pole on which the developer is accumulated is the pickoff pole.

5. The image forming apparatus according to claim 2, wherein at the clearance of the developing unit, a protruding portion that protrudes toward the developer roll is formed on an inner wall of the housing.

6. The image forming apparatus according to claim 1, wherein the connection path comprises:

an air vent hole formed at each of the plurality of developing units for removing air from an interior of within the developing units;

a discharge path that connects with each of the air vent holes for discharging the air removed from the air vent holes; and a filter member provided in the discharge path for eliminating the developer in the air discharged from the air vent holes.

7. An image forming apparatus comprising:

a plurality of developing units for developing a latent image with developer, each of the developing units comprising a housing having an opening and a developer roll disposed at the opening of the housing for supplying the developer to the latent image;

a connection path for connecting with the interiors of the plurality of developing units;

a control unit for controlling the operation of the plurality of developing units; and a developer moving unit filling a clearance between the housing and the developer roll of a developing unit that is not in operation with the developer by rotating the developer roll in a reverse direction to move developer adhered to the developer roll to the clearance when both a developing unit that is in operation and a developing unit that is not in operation are present among the plurality of developing units.

8. The image forming apparatus according to claim 7, wherein the connection path comprises:

an air vent hole formed at each of the plurality of developing units for removing air from an interior of within the developing units;

a discharge path that connects with each of the air vent holes for discharging the air removed from the air vent holes; and a filter member provided in the discharge path for eliminating the developer in the air discharged from the air vent holes.

9. The image forming apparatus according to claim 7, wherein at the clearance of the developing unit, a protruding portion that protrudes toward the developer roll is formed on an inner wall of the housing.

10. The image forming apparatus according to claim 7, wherein the developer moving unit moves developer accumulated on a repulsion pole of the developer roll.

11. An image forming apparatus comprising:

a plurality of developing units for developing a latent image with developer, each of the developing units comprising a housing having an opening and a developer roll disposed at the opening of the housing for supplying the developer to the latent image;

a connection path for connecting with the interiors of the plurality of developing units;

a control unit for controlling the operation of the plurality of developing units; and a developer moving unit filling a clearance between the housing and the developer roll of a developing unit that is not in operation with the developer by a magnetic member which moves developer adhered to the developer roll to the clearance by a magnetic force when both a developing unit that is in operation and a developing unit that is not in operation are present among the plurality of developing units.

12. The image forming apparatus according to claim 11, wherein the connection path comprises:

an air vent hole formed at each of the plurality of developing units for removing air from an interior of within the developing units;

a discharge path that connects with each of the air vent holes for discharging the air removed from the air vent holes; and a filter member provided in the discharge path for eliminating the developer in the air discharged from the air vent holes.

13. The image forming apparatus according to claim 11, wherein at the clearance of the developing unit, a protruding portion that protrudes toward the developer roll is formed on an inner wall of the housing.

14. The image forming apparatus according to claim 11, wherein the developer moving unit moves developer accumulated on a repulsion pole of the developer roll.

* * * * *